United States Patent [19]

Hayashi et al.

[11] Patent Number: 4,722,214

[45] Date of Patent: Feb. 2, 1988

[54] SPLIT DIE FOR HOLDING WORK DURING BENDING OPERATION

[75] Inventors: Yukio Hayashi, Chiba; Shigemi Ono, Funabashi; Akitoshi Suzuki, Tokyo, all of Japan

[73] Assignee: Murata Kikai Kabushiki Kaisha, Kyoto, Japan

[21] Appl. No.: 838,594

[22] Filed: Mar. 11, 1986

[30] Foreign Application Priority Data

| | | | |
|---|---|---|---|
| Mar. 12, 1985 | [JP] | Japan | 60-34148[U] |
| Mar. 12, 1985 | [JP] | Japan | 60-34149[U] |
| Mar. 12, 1985 | [JP] | Japan | 60-47404 |
| Mar. 12, 1985 | [JP] | Japan | 60-47405 |
| Mar. 12, 1985 | [JP] | Japan | 60-47406 |
| Apr. 11, 1985 | [JP] | Japan | 60-77294 |

[51] Int. Cl.[4] ..... B21D 5/04; B21D 37/04

[52] U.S. Cl. ..... 72/319; 72/413; 72/481

[58] Field of Search ..... 72/319, 320, 322, 323, 72/413, 473, 481, 482; 269/164

[56] References Cited

U.S. PATENT DOCUMENTS

| | | | |
|---|---|---|---|
| 2,301,958 | 11/1942 | Jensen | 72/319 |
| 4,089,198 | 5/1978 | Amano et al. | 72/320 |
| 4,112,731 | 9/1978 | Anderson et al. | 72/481 |
| 4,242,898 | 1/1981 | Salvagnini | 72/307 |
| 4,356,716 | 11/1982 | Aschauer | 72/322 |
| 4,532,792 | 8/1985 | Hongo | 72/319 |

FOREIGN PATENT DOCUMENTS

| | | | |
|---|---|---|---|
| 149026 | 9/1982 | Japan | 72/473 |
| 58-68445 | 10/1983 | Japan . | |
| 59-44616 | 3/1984 | Japan | 72/319 |

*Primary Examiner*—Daniel C. Crane

*Attorney, Agent, or Firm*—Burns, Doane, Swecker & Mathis

[57] ABSTRACT

Accurate and rapid folding of a sheet work is realized by a split die for holding the work in a folding machine or other similar machine, a method for the formation of the split die, and a work feeding apparatus for positional adjustment of the work for the sake of a folding operation, as contemplated by the present invention. The split die is composed of a pair of block dies adapted to be simultaneously moved in equal amounts away from or toward each other with respect to the center of the die of the folding machine and a multiplicity of segment dies to be inserted between the block dies. A die of a desired width for the folding operation is formed by moving the segment dies in the same direction in the same amount as one of the block dies and, at the same time, causing the key of an inverting shaft for selective extraction of segment dies to be moved in the same direction in the same amount as the other block die, and causing the segment dies falling within the overlapping regin to be thrown in between the block dies thereby apportioning the segment dies evenly on both sides of the center of the die of the folding machine.

10 Claims, 12 Drawing Figures

SPLIT DIE FOR HOLDING WORK DURING BENDING OPERATION

FIELD OF THE INVENTION

This invention relates to a die to be used in bending a sheet and a method for the assembly of the die. More particularly, this invention relates to a split die adapted to vary die width proportionately to a bending width of sheets, specifically a split die effectively used as a die for holding a work in a varying bending machine such as, for example, a folding machine, a bending machine, or a press brake and to a method for the assembly of the split die.

This invention further relates to an apparatus for feeding a plate work into a work holder die of the a folding machine or any of the conventional folding machines of the same kind and, after completion of the folding operation, withdrawing the folded product. To be more particular, this invention relates to feeding a work to a folding machine and, when necessary, suitably pushing in or pulling out the work relative to the working position of the folding machine and, after completion of the folding operation, withdrawing the finished product from the folding machine.

BACKGROUND OF THE INVENTION

In cabinets, showcases, vending machines, freezers and refrigerators, panels, sinks, switchboards, etc., metal sheets are used having edges thereof folded in cross sections of the shape of a channel or of the shape of the letter Z. The operation of forming such folds in a metal sheet generally involves first folding the shorter edges of a work cut in prescribed size and shape from a master metal sheet, rotating the work in its original plane at right angles to the shorter edges, and folding the longer edges of the work. In this case, when the longer edges are to be folded by a wing die, for example, since the work already contains the stand parts formed by folding along the shorter edges, the die for clamping the work, particularly the upper die, is required to have a length twice the thickness of the work less than the length of the longer edges of the work. It is, therefore, necessary that the die should be furnished with a multiplicity of upper dies of varying widths to permit interchange of such upper dies whenever there is a change of work width. The die of this principle inevitably entails expenditure of time and labor in the interchange of upper dies. Besides, this operation in most cases is performed manually and consequently prevents folding machines from being automated or adapted for an NC or CNC system. The desirability of a split die suitable for automatic control and an apparatus for interchange of segments of the die has found recognition.

Description of the Prior Art

As one answer to satisfy this desire, there has been proposed a die interchange apparatus which, as illustrated in FIG. 10, comprises an upper die holder 101 attached to the lower end of a ram, block dies 102 disposed slidably in the direction of width of the die below the upper die holder 101, a multiplicity of thin-wall invertible upper segment dies 103, a select claw drive mechanism 104 disposed in front of the upper die holder, and an inverting mechanism 105 capable of inverting a stated number of segment dies 103, whereby interchange of a die is automatically and easily effected by causing the part of block dies 102 exceeding a given working width to be moved by a select claw 106 to a position separated from the working position, namely outwardly along the upper die holder 101 and, at the same time, causing the part of block dies 102 equaling the total width of the thin-wall segment dies 103 which have been inverted to be gathered toward the center thereby forming a joint series of an upper die as disclosed in Japanese Utility Model Application Laid-open No. SHO 59(1984)-44,616).

This die changing device, however, is incapable of symmetrically apportioning the split die longitudinally relative to a given reference point such as, for example, the center of the machine because, in the sort of a desired number of segment dies 103 from the group of upper segment dies 103 for the group of segment dies 103 prepared for the purpose of adjusting a value not equally divisible by one split block die 102, the desired number of segment dies 103 fixed with reference to one end of the group of segment dies 103 are picked out and inverted by a spline shaft 107. Since the center of the die is not always fixed but is shifted by the number of segment dies 103 selected each time, the apparatus has the disadvantage that the centering of work feeding, i.e. the alignment of the center of the machine with that of the die, must be renewed whenever there is a change of work width.

As a means of feeding a work to the aforementioned folding machine or any of the known folding machines of the same kind, various apparatuses have been disclosed in U.S. Pat. No. 4,242,898 and Japanese Patent Application Laid-open No. SHO 58(1983)-168,445. The work feeding apparatus disclosed in Japanese Patent Application Laid-open No. SHO 58(1983)-168,445 is constructed, as illustrated in FIG. 11, to receive a work W introduced sidewise in a direction traversing the apparatus in a stopper (not shown) on a work delivery line kept at a position controlled in advance and adapted to adjust its own width to the work W. The forward end of the work is pressed manually at the reference position in the feeding direction and determine the origin (for aligning the forward end of the work with a predetermined reference position in the feeding direction), cause a clamping device 202 of a carriage 201 to pinch the work W, and advance the carriage 201 in a stroke by the elongation of a hydraulic sylinder 204 until against a sliding block 203 moved in advance to a stated position and thereby, impart to the work W a motion to a folding machine 205. This apparatus effects the determination of the die width and the selection of the origin of folding operation only during the first stage in which the work W is clamped and, thereafter, effects the feeding, rotation, and other operations on the work W on the condition that the clamp position is absolutely correct.

Since the conventional apparatus described above pinches a give work W at one point with a clamp means 202 having a small diameter as compared with the dimensions of the work, it cannot easily prevent the work W from being moved by inertia during the rotation thereof and inevitably the work deviates from the fixed position thereof. This deviation becomes increasingly apparent in proportion as the dimensions of the work increase. Moreover, where no means is available, as in the aforementioned conventional work feeding apparatus, for liberating the work W between the time the work W is clamped and the time it is ready for removal after all the edges thereof have been folded or for enabling the work W to be automatically moved relative to the folding machine, the aforementioned deviation is not corrected but is amplified or aggravated gradually. Thus, when this work feeding apparatus is put to use, the folded product obtained thereby suffers from inferior precision.

For actual adoption, however, the conventional work feeding apparatus which, once the work W is clamped, does not set free the work W until the whole folding operation is completed has the disadvantage that the minimum folding width is relatively large because an attempt to perform the whole folding operation based solely on the initial determination of the origin and the work width requires the work W to be clamped at the center thereof without fail and necessitates allowance of at least a clearance capable of avoiding mutual interference between the clamping device 202 and a gooseneck bending die (work holder for immobilizing the work W) 206 of the folding machine 205 and, at the same time, permitting a thrust of the work W to be produced for precluding the aforementioned bending die 206 and the leading edge of the folded work W from interfering with each other in the vertical direction. To be specific, the minimum work bending width available at all for the folding machine is approximately twice the sum of the thickness in the feeding direction of the gooseneck bending die 206, the radius of the clamping device 202, and the amount of thrust of the work.

SUMMARY OF THE INVENTION

The first object of this invention is to provide a split die for a folding operation capable of being automatically apportioned symmetrically in the longitudinal direction relative to the center of a folding machine and a method for the assembly of the split die.

The second object of this invention is to provide a split die for a folding operation capable of being automatically apportioned symmetrically in the longitudinal direction relative to the folding machine and, at the same time, capable of being automatically restored to the inherent die width when the die width narrows and the die closes during an elevation of the die.

The third object of this invention is to provide a work feeding apparatus which possesses high feeding precision and is capable of giving a stated feeding to a given edge of a work even when the work is clamped at an arbitrary position other than the center of the work, i.e. the work feeding apparatus which, when used for a folding machine, improves the folding precision and enables the minimum folding width to be decreased to a relatively small value.

The objects described above are accomplished by a split die which comprises a multiplicity of laterally split thin-plate segment dies, a pair of block dies disposed one each at the opposite ends of the group of segment dies and adapted to move simultaneously in an equal amount away from or toward each other in the width direction of the die, and a shifting mechanism for removing equal numbers of segment dies from the opposite ends of the group of segment dies thereby extracting a desired number of segment dies and inverting the extracted segments dies and inserting them between the block dies, a folding die of a desired width will be formed as symmetrically apportioned in the direction of length relative to the center of the die.

The objects are further accomplished by a method for the assembly of the aforementioned work holding split die adapted to form a folding die of a desired width by the combination of a pair of block dies and a multiplicity of thin-plate segment dies, which method comprises moving the block dies simultaneously in an equal amount away from or toward each other to positions separated from the center of the die by multiples of the wall thickness of the segment dies, extracting from the group of segment dies a corresponding integer of segment dies and injecting the extracted segment dies between separated block dies.

The objects are also accomplished by a work feeding apparatus which comprises a front table for supporting a delivered work, a width-determining mechanism for centering the work in the direction of width perpendicular to the direction of feeding of the work with claw members adapted to approach each other in an equal amount towards the center of feeding coinciding with the center of a folding machine destined to receive the work, an origin-fixing mechanism for positioning the work in the direction of feeding by freely protruding from the plane of work feeding and coming into contact with the forwarding end of the work at least at two points, a carriage provided at the leading end thereof with a clamping means capable of nipping the work and rotating it by a stated angle in a horizontal plane and adapted to push in or pull out the work in a stated amount, and a sub-carriage mounted on the carriage and adapted to move independently in the same direction as the carriage so as to push out or draw in the work while the work is not clamped, whereby the work, whenever one of the edges thereof has been folded, is given a feeding motion after the work feeding apparatus has fixed the width and the origin of the work.

DESCRIPTION OF PREFERRED EMBODIMENT

Figure 1:
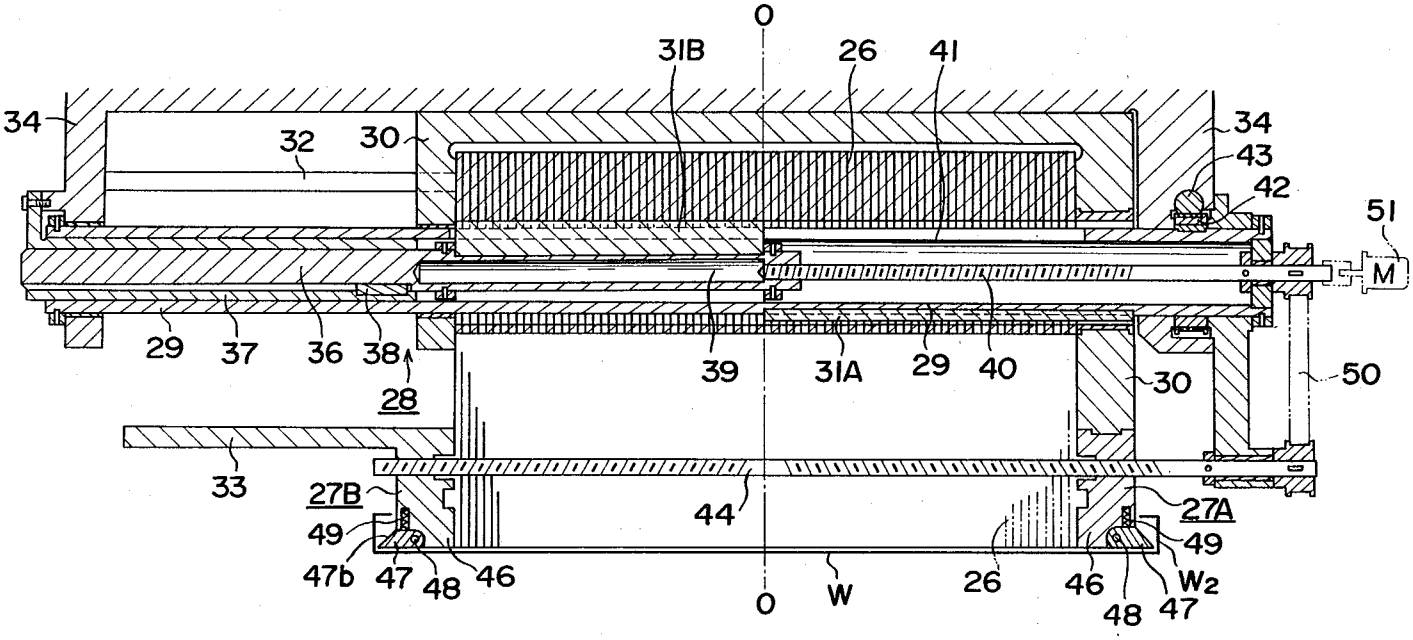
FIGS. 1(A) and 1(B) are principle diagrams illustrating in front elevation a typical split die for folding operation as one embodiment of this invention (A) representing the state assumed before the inversion andinsertion of segments arrayed in the maximum width and (B) the state in which segments arrayed assumes the minimum width.
Figure 1:
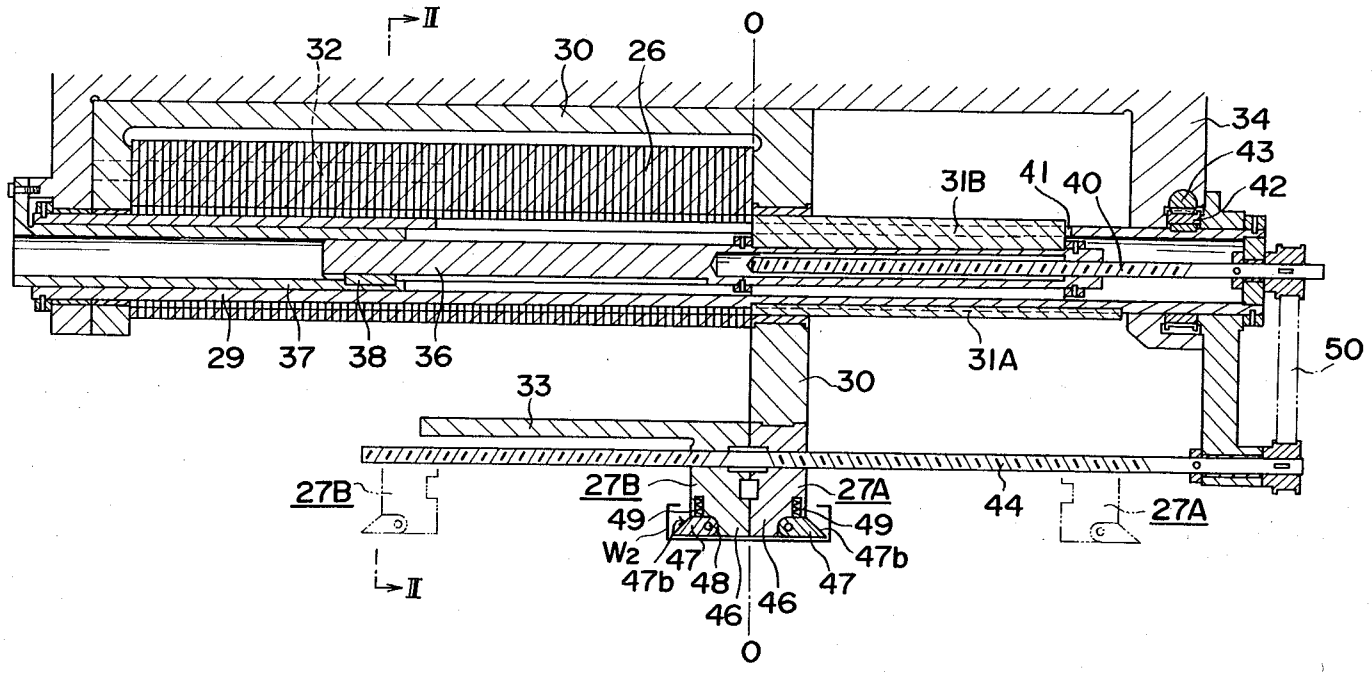

Now, the construction of the present invention will be described in detail below with respect to one embodiment illustrated in the drawings. This embodiment consists in an upper die of a folding machine.

Figure 3:
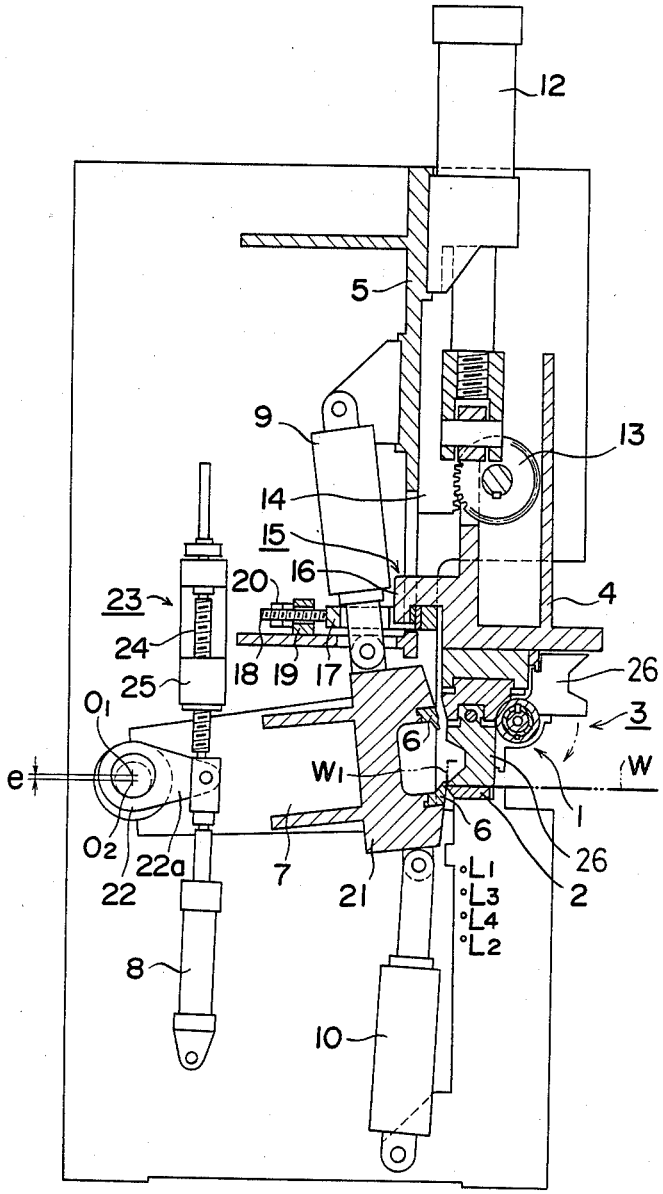
FIG. 3 is a principle diagram schematically illustrating a sheet folding machine utilizing a split die of the present invention.

FIG. 3 is a principle diagram schematically illustrating a folding machine proper incorporating therein a split die of the present invention. This folding machine proper is composed mainly of a work holder 3 consisting of an upper die 1 attached to a ram and consequently allowed to rise and fall in conjunction therewith and a lower die 2 fixed to a frame 5, a rocker arm 7 having provided at the leading end thereof with a folding blade (hereinafter abbreviated occasionally as "blade") 6 adapted to fold in the vertical direction the leading end $W_1$ of a work W retained by the work holder 3, drive actuators 8, 9 and 10 for swinging or horizontally moving the arm 7, and a machine supporting frame 5 therefor.

The upper die 1 and the lower die 2 which jointly form the work holder 3 generally possess inwardly oblique flanks at least in the front end faces and the opposite lateral end faces thereof so that a given edge of the work W will be folded by an angle exceeding a right angle. The upper die 1 is constructed in the form of a split die capable of varying the width thereof in conformity with the width of the work W in accordance with this invention. In the case of the present embodiment, for example, the upper die 1 is formed in a prescribed width by the combination of thin-plate segment dies and one pair of block dies disposed one each at the opposite ends of the group of segment dies, so that equal numbers of segment dies will be extracted on both sides of the center of the upper die and inverted and inserted between the block dies. The upper die 1 is attached to the ram 4 and adapted to be freely raised or lowered by the operation of a drive cylinder 12. The motions thereof at the longitudinally opposite ends are synchronized by the mutual engagement between gears 13 coaxially disposed at the opposite ends and rack 14 fastened to the frame 5, with the result that the upper die 1 will be smoothly raised and lowered straightly. This upper die 1 will be described further in detail afterward.

The ram 4 supporting the upper die 1 is provided with a back-up device 15 so as to prevent the upper die 1 from being curved during a folding operation and ensure formation of a straight folding line. This back-up device 15 is composed of a heel 16 formed integrally with the ram 4 and a block 17 set on the machine frame 5. During the closure of the work holder 3, the heel 16 and the block 17 come into mutual engagement and jointly give a push relatively to the upper die 1 so that the upper die 1 will be prevented from being pushed back during the folding operation. The block 17 has a position adjusting screw bar 18 and is enabled to adjust the amount of back-up motion by having the screw bar 18 pass through a bracket 19 fastened to the machine frame 5 and then meshed with a position adjusting nut 20.

Figure 5:
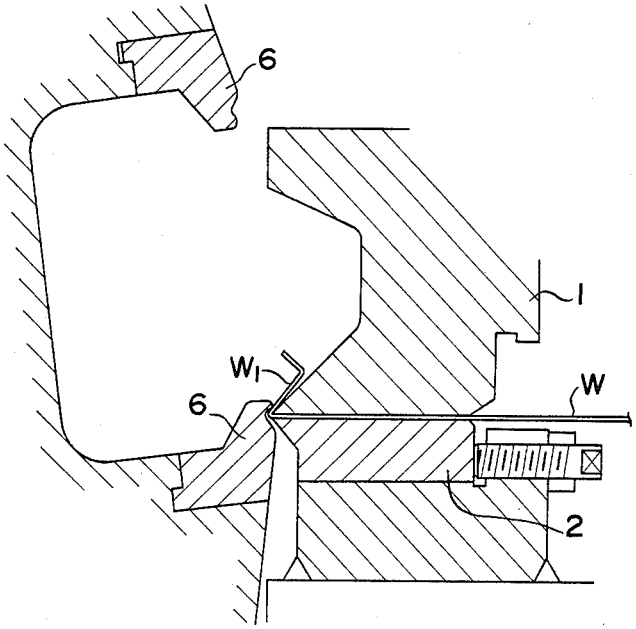
FIG. 5 is a magnified cross section of a folding die part for illustrating schematically the folding operation.

The blade 6 for folding the leading end $W_1$ of the work W retained by the work holder 3 is fixedly attached to a C-shaped blade holder 21 at the leading end of the rocker-arm 7 which may be moved substantially perpendicularly relative to the work W and allowed to pass the work holder 3 closely in front of it substantially in the vertical direction. This blade 6 has a folding surface of a cross secion of the shape of the letter L in a slightly diverged pattern in conformity with the contour of the leading end of the work holder 3 in a closed state. It is fixedly attached to the upper and lower ends of the C-shaped blade holder 3 (FIG. 5).

Figure 4:
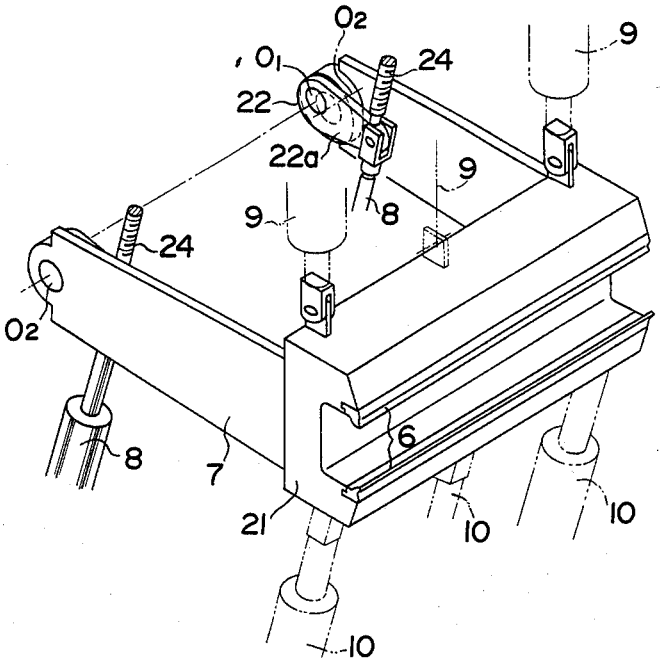
FIG. 4 is a perspective view of a rocker arm part.

The rocker-arm 7 mentioned above is fastened, as illustrated in FIG. 3 and FIG. 4, via an eccentric member 22 to the machine frame 5 and adapted to be swung about the center $O_2$ of rotation positioned on the eccentric member 22. This rocker-arm 7 is provided in the blade holder 21 part at the leading end thereof with actuators 9, 10 disposed vertically relative to each other. These actuators are adapted so that their simultaneous motions will swing the rocker-arm 7 freely within a stated range in a desired direction and bring it to a stop at a desired position. The actuators 9, 10 are each formed of a double-acting hydraulic cylinder. The first chamber of the upper actuator 9 is connected to the second chamber of the lower actuator 10 and the second chamber of the upper actuator 9 is connected to the first chamber of the lower actuator 10. They are so disposed that when one of the actuators 9 or 10 is extended, the other actuator 10 or 9 is contracted at the same time. As the result, the rocker-arm 7 is pulled up as soon as it is pushed up or it is pulled down as soon as it is pushed down, so as to be rapidly and smoothly swung in the vertical direction while experiencing alleviated resistance to motion. The term "first chamber" as used in this specification means the chamber of the side accommodating the piston rod and the term "second chamber that of the opposite side".

The eccentric member 22 having the rocker-arm 7 attached rotatably thereto is a disc possessing the center $O_2$ of rotation of the rocker-arm 7 at a position offset by a distance of e from the center $O_1$ of rotation of itself relative to the frame 5. An actuator 8 is connected to a link part 22*a* which has part of the periphery thereof protruded in the radial direction, so as to impart a swinging motion freely to the actuator. The rotation of the swinging member 22 implies a change of the center of rotation of the rocker-arm 7 or an alteration of the magnitude of approach of the blade 6 to the work holder 3 and results in a variation in the folding angle of the work W. Thus, an adjustable stopper 23 which fixes the ends of a swinging motion for regulating the amount of rotation of the eccentric member 22 is disposed opposite the actuator 8. In the present embodiment, this stopper 23 is composed of a reversibly rotatable screw rod 24 and a bracket 25 having inserted therein a female screw adapted to be helically joined to the screw rod, so that the screw rod 24 will be thrust out toward the actuator as desired or in accordance with a program.

The positions to which the rocker-arm 7 and consequently the blade 6 are retracted are suitably changed in accordance with the conditions of folding operation, for example, by means of limit switches $L_1$, $L_2$, $L_3$ and $L_4$ to avoid inducing any wasteful vertical motion. The limit switches $L_1$, $L_2$ are disposed near the two stroke ends of the actuator 10 to fix the end of rising motion and the end of falling motion of the upper and lower blades 6. Between the two limit switches, as many limit switches as required in fixing the position to which the blade 6 are disposed. For example, the limit switches $L_3$, $L_4$ are disposed, one at a point at which the lower blade is positioned directly below the work holder 3 and the other at a point at which the upper blade is positioned directly above the work holder 3, so that the blade 6 on the side about to be used will be retracted near the work holder 3 so as to avoid inducing any wasteful motion. In this arrangement, the blade 6 can be retracted as programmed or by a manual operation to either the position of the limit switch $L_3$ or the position of the limit switch $L_4$, depending on the direction of the next folding operation, to preclude the otherwise inevitable generation of a wasteful stroke.

FIG. 1 (A), (B) are principle diagrams illustrating in front elevation one typical split die for a folding operation as an embodiment of the present invention. This split due for a folding operation (hereinafter referred to simply as "split die") comprises a group of thin-plate segment dies 26 finely split in the direction of width, a pair of block dies 27A, 27B disposed one each at the opposite ends of the segment dies 26, and a shifting mechanism 28 for extracting a stated number of segment dies 26 and inserting the extracted segment dies between the block dies 27A, 27B. The shifting mechanism 28 is composed of an inverting shaft 29 for supporting the segment dies 26, a segment holder 30 for moving the segment dies 26 along the inverting shaft 29, a set of selection keys 31A, 31B for selectively connecting the inverting shaft 29 to the segment dies 26, and stoppers 32, 33 for fixing the segment dies 26 which have escaped being caught by the selection keys 31A, 31B.

The segment dies 26 are thin plates of a wall thickness of about 5 mm, for example, obtained by finely splitting a die of a desired shape for folding operation in the direction of width (hereinafter referred to briefly as "direction of width" or "direction of die width"). When many of these segment dies are gathered into one tight group, they form a main part of the split die for the folding operation. These segment dies 26 are set on the inverting shaft 29 of the shifting mechanism 28 supported rotatably on the upper die proper 34 secured to the ram 4, for example, of the folding machine proper and are supported so as to be swung in planes perpendicular to the direction of die width. The group of segment dies 26 and the inverting shaft 29 are selectively connected to each other with the selection keys 31A, 31B, so that a desired number of segment dies will be interlocked. The group of segment dies 26 are so disposed that they will be retained by the segment holder 30 as one component of the shifting mechanism 28 and collectively moved along the inverting shaft 29 in the direction of width.

The segment holder 30 is attached to the upper die proper 34 through the medium of a sliding gib 35 and adapted to be freely slidable in the direction of die width. This means that the segment holder 30 is driven by one of the block dies 27A.

The inverting shaft 29 incorporates therein a feed shaft 36 for retaining the movable key (one of the selection keys) 31B and feeding it in the direction of die width. This feed shaft 36 is supported in position by a cylindrical bearing 37 interposed between the feed shaft 36 and the inverting shaft 29 and adapted to be moved only in the axial direction by a slide key 38 interposed between the feed shaft 36 and the inverting shaft 29. A first screw rod 40 is helically inserted in a cavity 39 at the leading end of the feed shaft 36, so that the rotation of the screw rod 40 will move the feed shaft 36 in the direction of width. To permit the movable key 31B to move in the axial direction, the inverting shaft 29 is provided with a long groove 41 formed in the axial direction. With this long groove as a guide, the movable key 31B is allowed to move accurately in the direction of width, namely in the axial direction of the inverting shaft 29. The inverting shaft 29 is provided at one end thereof with a gear 42, which is meshed with a rack bar 43 adapted to be driven by a hydraulic cylinder (not shown). By the linear motion of the hydraulic cylinder, therefore, the inverting shaft 29 is rotated through a stated angle such as, for example, 180°.

The pair of block dies 27A, 27B located one each at the opposite ends of the segment dies 26 are severally supported by a second screw rod 44 supported rotatably on the upper die 34 and are slidably inserted into the segment holder 30 through the medium of a sliding gib 45 and, as the result, are enabled to be linearly moved simultaneously in equal amounts away from or toward each other in the direction of width as a result of the rotation of the second screw rod 44. The block dies 27A, 27B are composed of a block proper 46 and a movable piece 47 attached swingable in the direction of die width to the block 46. By causing the movable piece 47 to form the outer edge parts of the block dies 27A, 27B these block dies are allowed to have their die width variable. The movable piece 47 is attached with a pin 48 to the block 46 so as to be slidable in the direction of width. Normally, therefore, the movable piece is urged toward the work W side, namely, downwardly by a compression coil spring 49 and held substantially in the vertical direction. When the die is closed, therefore, the movable piece 47 is rotated so as to be pressed against the work W and spread outwardly. The widths of the block dies 27A, 27B are different when the die is closed and when it is opened. They are restored to their inherent widths only when the die is closed. The movable piece 47 has the upper surfaces **47*a*, 47*b* on the front and lateral sides slanted so that they will avoid interfering with the front edge $W_1$ and the lateral edges $W_2$ of the work which have been folded. This movable piece 47 falls flush with the bottom surface of the block proper 46 and front slanted surface 47*a* and the lateral slanted surfaces 47*b* protrude from the block proper 46** when the die is closed.

The second screw rod 44 supporting the block dies 27A, 27B has reverse screws of a fixed pitch cut on the left and right sides, so that the rotation of this second screw rod 44 will move the opposed block dies 27A, 27B toward or away from each other. The second screw rod 44 and the first screw rod 40 are interconnected with a timing belt 50 and are synchronously rotated by the rotation of a drive motor 51. The screws in the lefthand side regions shown in the diagrams of the first screw rod 40 and the second screw rod 44 inside the inverting shaft 29 are cut at a fixed pitch in the same direction and the movable key 31B and the block die 27B on the lefthand side shown in the diagrams are disposed so as to be moved simultaneously in equal amounts in the same direction.

Figure 2:
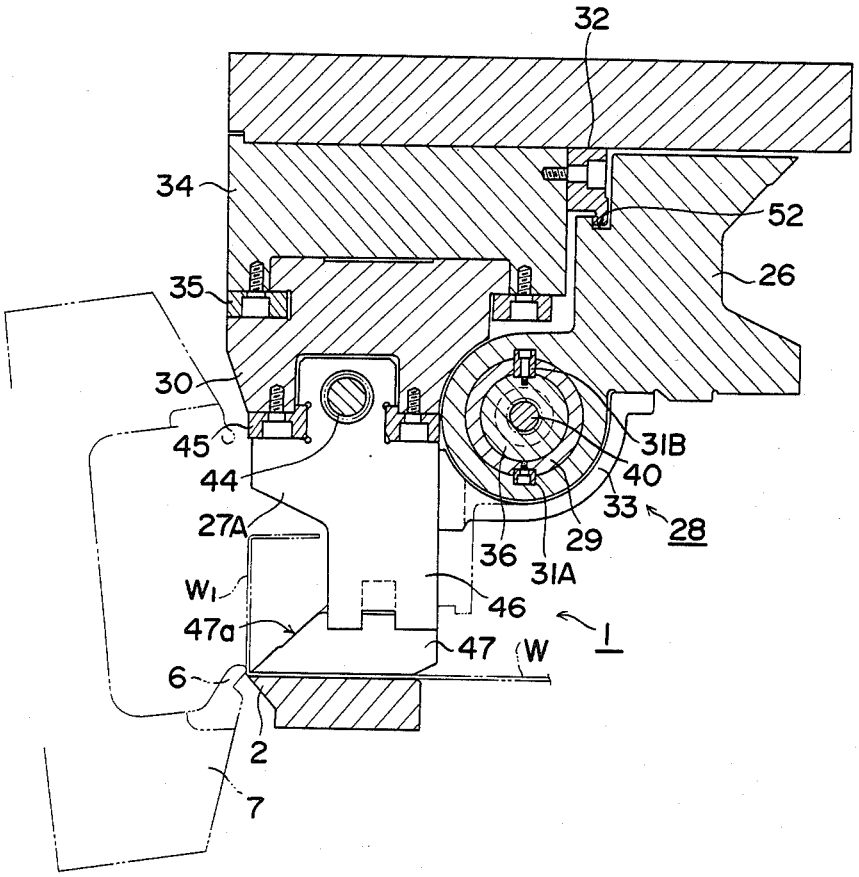
FIG. 2 is a cross section taken along the line II—II of FIG. 1 (B).

The upper die 34 is provided with a stopper 32 adapted to prevent the segment dies 26 relesed from the selection keys 31A, 31B from being freely rotated in the directions of the block dies 27A, 27B. This stopper 32 is a sliding key which comes into engagement with a notch 52 formed on the rear side of a segment die 26. It is extended to the position nearest to the segment die 26 on the lefthand end when all the segment dies 26 assume the largest width by being inverted and inserted between the block dies 27A, 27B, namely when all the segment dies 26 are equally apportioned to the left and right sides of the center 0—0 of the die (FIG. 1 (A)). In this arrangement, therefore, the stopper 32 slides into the aforementioned notch 52 and restrains the segment dies 26 as soon as the segment die 26 on the lefthand end is released from the selection keys 31A, 31B. The block die 27B is similarly provided with a stopper 33. This stopper 33 prevents any of the segment dies 26 between the leading end of the stopper 33 and the center 0—0 of the machine from being freely rotated after they have been released from the selection keys 31A, 31B. As shown in FIG. 2, the stopper 33 is a receiving device formed in the shape of one quarter of a circle integrally with the block die 27B. The stoppers 32, 33 are effective in inverting and inserting a desired number of segment dies 26. Optionally, they may be replaced by means capable of increasing the angle of inversion and preventing rotation by gravitational attraction.

The selection keys 31A, 31B are sliding keys of a kind allowed to slide smoothly relative to the segment dies 26. They comprise a stationary key 31A positioned on the righthand side relative to the center of the machine or the center 0—0 of the die and a movable key 31B positioned on the lefthand side. By having the movable key 31B moved counter to a group of segment dies 26 being moved in conjunction with the block die 27A in the same amount and, at the same time, having the stationary key 31A pulled out in the same amount from the segment dies 26, equal numbers of segment dies 26 are extracted from both sides of the center 0—0 of the machine. In the present embodiment, since desired segment dies 26 selected from only one side of the group of segment dies 26 are released from the selection keys 31A, 31B and further since a given group of segment dies are moved in the same amount away from the movable key 31B, substantially the same number of segment dies 26 are lost in effect from the opposite end. As the result, equal numbers of segment dies 26 are removed from the opposite ends.

The embodiment so far described represents one working example and may be suitably modified or altered without departing from the spirit of the present invention. For example, the number of the selection keys 31A, 31B of the shifting mechanism 28 may be increased or the selection dies themselves may be substituted as by spline shafts. The shifting mechanism 28 may be allowed to effect the selection of segment dies 26 by causing selection keys adapted to protrude freely in the radial direction and possessed of the same width as the segment dies 26 to be protruded in equal amounts from the center of the die toward the opposite ends. In the present embodiment, the segment dies 26 are adapted to be inverted and then insrerted between the block dies 27A, 27B. Optionally, this setup may be altered so that freely extraced segment dies will be raised or lowered and, thus, interposed between the block dies 27A, 27B. In the present embodiment, the block dies 27A, 27B at the opposite ends are designed as variable-width dies provided with movable pieces 47. Optionally, these block dies 27A, 27B may be designed as fixed-width dies not furnished with movable pieces 47 by incorporating width adjusting dies (not shown) adapted to be freely inserted between the block dies and the segment dies.

Figure 6:
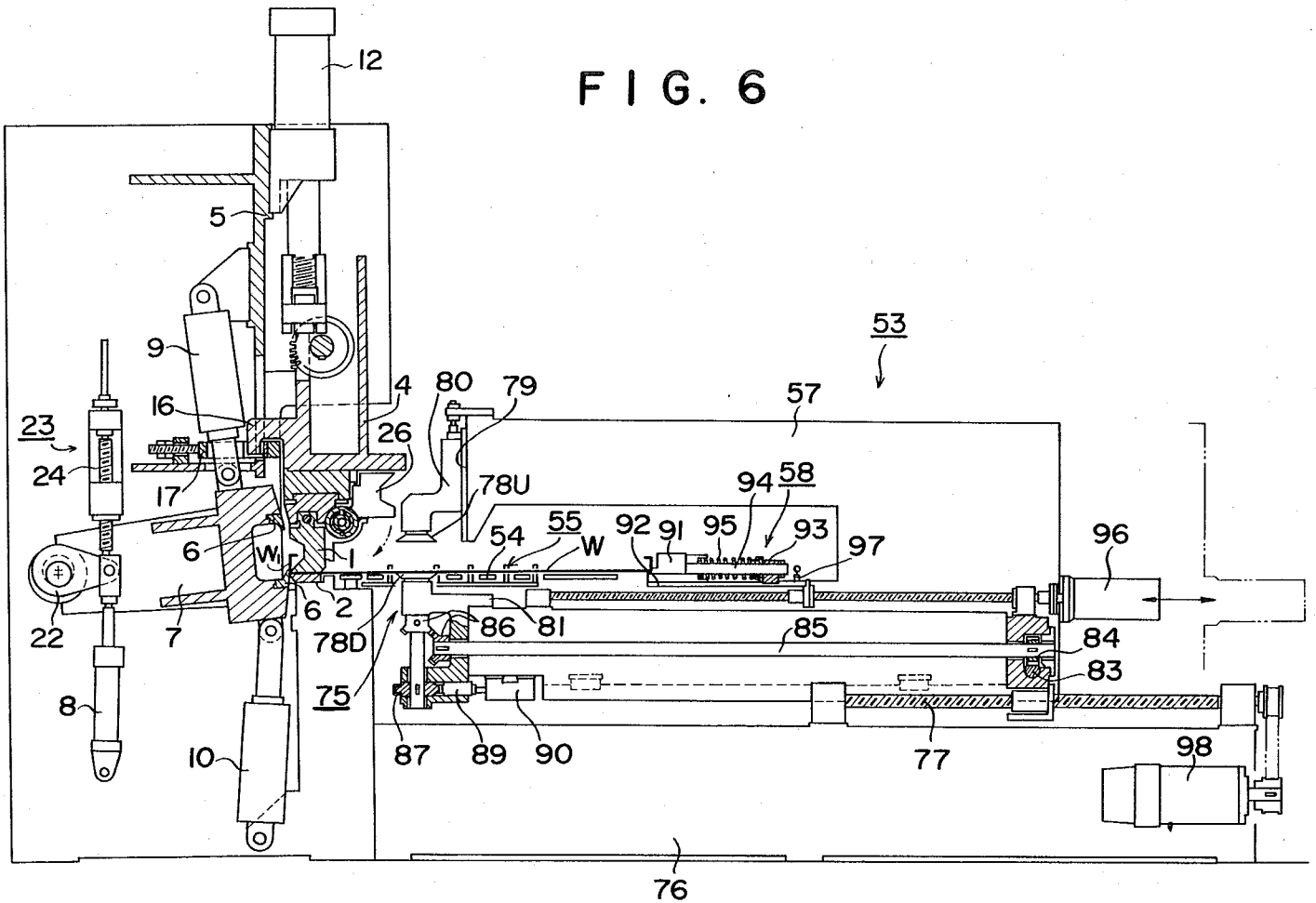
FIG. 6 is a longitudinal cross section of the entire folding machine including a work feeding apparatus.
Figure 7:
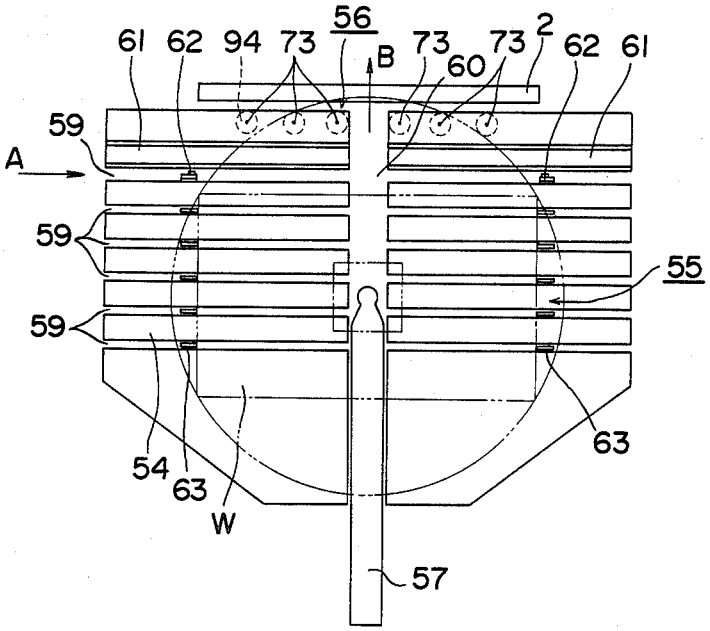
FIG. 7 is a plan view of a front table.
Figure 8:
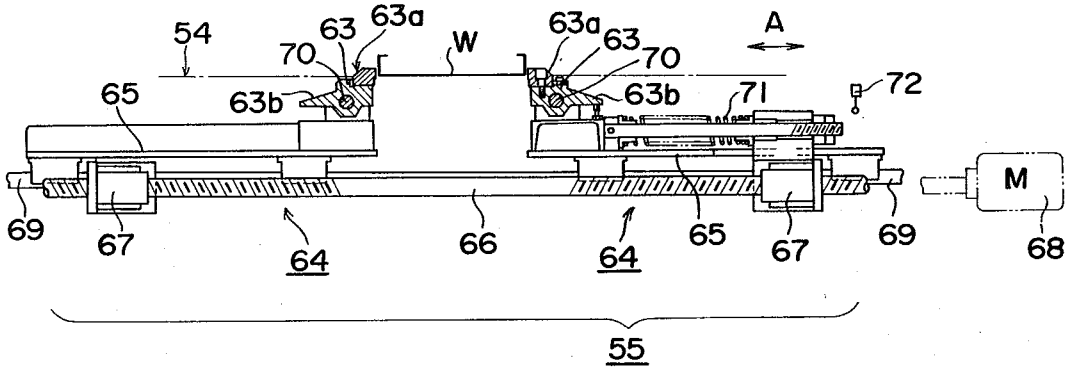
FIG. 8 is a schematic diagram for illustrating the principle of a width-determining mechnism.

The work feeding apparatus for feeding a work to the aforementioned folding machine proper or to any of the known folding machines of the same kind is illustrated in FIG. 6 through FIG. 8. This work feeding apparatus 53 comprises a front table 54 for supporting a delivered work W, a width determining mechanism 55 for fixing the position of the work W on the table 54 relative to the direction of width, an origin determining mechanism 56 for setting the work W at the position fixed for starting the feeding motion, a carriage 57 for nipping the work W and imparting a desired feeding motion to the work W, and a sub-carriage 58 for imparting a motion to the work W where not in a clamped state. It is disposed in front of the folding machine in a direction perpendicular to the line for transporting the work W.

The front table 54 mentioned above is an aggregate of oblong tables which, as illustrated in FIG. 7, form a plurality of passages 59 for the movement of claw members 63 of the width-determining mechanism 55 in the direction of work conveyance (indicated by the arrow "A" in the diagram) and passages 60 for permitting passage of the carriage 57 in the work feeding direction (indicated by the arrow "B" in the diagram) perpendicular to the direction A of work conveyance. Below this front table 54, magnet conveyors 61 serving to in and out the work W are laid as opposed to each other across the carriage passage 60. The magnet conveyors 61 are formed by using a rubber belt containing magents or an adsorbent belt provided with magents in the place of the belt in a belt conveyor. They attract the work W and convey it substantially to the center of the front table 54 or convey it out of the table 54. Desirably, these conveyors 61 are adapted so that they are moved at a fixed speed and, after a limit switch 62 or some other similar sensor has confirmed the passage of the work W across a certain point, they are stopped after elapse of a suitable time so as to bring the work W to the center of the table 54. Of course, this step of the conveyors may be effected manually under the observation of a worker.

The width-determining mechanism 55 which fixes the position of the work W in the direction of width (the direction A of work conveyance) is composed, as illustrated in FIG. 8, of claw members 63 adapted to move inside the passage 59 of the front table 54 in the direction A of work conveyance and feeding mechanism 64 for supporting the claw members 63 and moving them in equal amounts towards the center of the carriage passage 60 at the center of the table in the direction A of work conveyance. Here, the feeding mechanism 64 is composed of a sliding table 65 for supporting the claw members 63, one screw bar 66 having reverse screws cut at a fixed pitch in the opposite parts thereof, a nut 67 for interconnecting the screw bar 66 and the sliding table 65, a drive motor for driving the screw bar 66, and guide rods 69 for supporting the sliding table 65 and is intended to enable the claw members 63 on the sliding table to be fed in equal amounts away from or toward each other with the carriage 60 as the center. As the feed screws 66, 67, ball screws suitable for the NC system may be adopted advantageously.

The claw members 63 are disposed swingably in the direction A of work conveyance on the sliding table 65 through the medium of pivots 70. These claw members 63 are both adapted to be rotatable inwardly, namely toward the carriage passage 60 side. They have the outer surfaces **63*a* of the parts protruding from the front table 54 slanted, so that when the work W is brought in either direction, the claw members will be allowed to incline inwardly and sink below the front table 54 for the work W to be passed safely thereon. Normally, the claw members 63 are kept thrust out on the front table by the function of a rearwardly protruding weight part 63*b* and they are not enabled to rotate outwardly but are adapted to function as stoppers. When the work W intervenes between them, they nip the work W and place it exactly at the center of the table. The sliding table 65 and the nut 67 are interconnected to each other through the medium of a spring 71. When the claw members 63 develop resistance exceeding a certain level, the spring 71 is contracted substantially to stop the vibration of the claw members 63 and prevent the work W from being deformed. As the result, the width-determining mechanism 55 drives the ball screw rod 66 in such a manner that the claw members 63 will form a prescribed width on the basis of data on the work W fed in advance. In actuality, when the claw members 63** tend to converge to a distance less than the work width, the contraction of the spring 71 serves to preclude the excessive convergence. In this case, any excessive movement of the nut 67 is precluded because a limit switch 72 detects it and immediately stops the drive motor 68.

The origin-fixing mechanism 56 is adapted to protrude freely from the feeding surface for the work W, i.e. the upper side of the front table 54 and come into contact with the work W at least at two points and set the work in the fixed position for starting the feeding motion. In the case of the present embodiment, the origin-fixing mechanism 56 is disposed evenly relative to the carriage passage 60 as the center in a direction perpendicular to the feeding direction and is adapted to cause origin-fixing pins (locating pins) 73 to thrust out selectively in conformity with the width of the work W being introduced. The extraction and the reaction of the origin-fixing pins 73 are severally effected by a cylinder actuator 74 in the case of the present embodiment. The origin-fixing pins 73 of the present embodiment are adapted to function concurrently as sensors for detecting the presence of the stoppers for receiving the work W and the work W itself by passing an electric curent between the origin-fixing pins 73 disposed on both sides and electrically determining whether or not the work W is in contact with the two pins 73. Optionally, sensors exclusively serving to detect the presence of the work W may be additionally adopted instead of concurrently using the origin-fixing pins 73 as such sensors. Otherwise, two movable pins may be disposed so as to be moved in equal amounts away from or toward each other in conformity with the variation in the work width.

The carriage 57 is provided at the leading end thereof with clamping means 75 capable of nipping the work W and rotating it by a stated angle in a horizontal plane. The clamping means 75 is adapted to traverse the front table 54 and impart a stated feeding to the work W. This carriage 57 is mounted in a guide rail (not shown) of a bed 76 and adapted to be moved by a feed screw 77 in the direction B of work feeding. As the feeding screw 77, a ball screw generally suitable for the NC servo mechanism is adopted. By moving the carriage 57 in its entirety, feeding screw 77 imparts a stated feeding to the work W. The rotation of the feeding screw 77 is controlled by a drive motor such as, for example, a DC control motor 98.

The clamping means 75 is composed of a pair of rotatable clamping plates 78U, 78D which are capable of nipping the work W in the vertical direction. It is so disposed that one of the clamping plates, generally the upper clamping plate 78U will be allowed to move in the vertical direction and enabled to nip the work W brought in onto the front table. The upper clamping plate 78U is rotatably attached to a holder 80 capable of being moved in the vertical direction along a guide rail 79 at the leading end of the carriage 57. The vertical motion of the holder 80 which supports the upper clamping plate 78U is effected by the operation of a cylindrical actuator incorporated therein or by the rotation of a ball screw. The clamping plate 78D on the lower side (hereinafter referred to as "lower clamping plate") is rotatably supported on a bracket 81 which is secured to the front end of the carriage 57. A rotary shaft 82 of the lower clamping plate 78D is provided with a rotary drive mechanism and a dividing mechanism so as to be rotated by a desired angle or brought to a stop.

The rotary drive means mentioned above is intended to impart a stated amount of rotation to the work W relative to the lower clamping plate 78D. In the case of the present embodiment, the linear motion of a cylindrical actuator (not shown) is transformed into a rotation of the shaft 85 inside the carriage through the medium of a rack 83 and a pinion gear 84 and this rotation is further transmitted to the lower clamping plate 78D through the medium of a pair of bevel gears 86. The rotation so imparted to the clamping means 75 may be in either direction. Thus, a rotation by an angle not exceeding 180° suffices. Thus, the cylindrical actuator to be adopted is desired to possess a stroke enough to rotate the rotary shaft 82 by either 180° or 90°.

The dividing mechanism is intended to stop the rotation of the clamping means 75 at a stated angle without fail and is composed of a dividing disc 87 and a dividing pin 89 adapted to be meshed with notches 88 on the periphery of the disc 87. By the dividing pin 89 which is freely projected by a cylindrical actuator 90, the position for stopping the dividing disc 87 and consequently that of the lower clamping plate 78D can be determined.

The carriage 57 mentioned above is provided with a sub-carriage 58. This sub-carriage 58 moves in the same direction as the carriage 57, i.e. in the direction B of feeding so as to impart a motion to the work W while the work W is not in a clamped state. It is driven by a feeding mechanism of its own. A block 91 at the leading end of the subcarriage 58 which collides with the work W is an electromagnetic chuck. When necessary, it is disposed so as to be enabled to attract and pull out the work W. The block 91 is attached to the leading end of a sliding rod 94 supported by a bracket 93 on a base 92 and is adapted to collide with the rear end of the work W and move backwardly when it is pressed by the work W. Between the block 91 and the bracket 93, a contracting coil spring 95 is interposed. This contracting coil spring 95 is adapted so as to keep the block 91 urged forward at all times and, it is exposed to the repelling force generated on the work side to overcome the resilient force of the spring 95 and permit backward movement. The backward motion of the block 91 is effective in preventing the work W from deformation. This prevention becomes increasingly difficult as the contraction of the spring 95 increases. On the path for the motion of the sliding rod 94, therefore, there is provided a limit switch 97 intended to detect the motion of the rod 94 and stop the drive motor 96.

By the folding machine which incorporates the split die of this invention constructed as described above and the work feeding apparatus for feeding a work to the folding machine and withdrawing the product from the folding machine, the sheet work can be folded accurately in a desired shape as follows.

Figure 9:
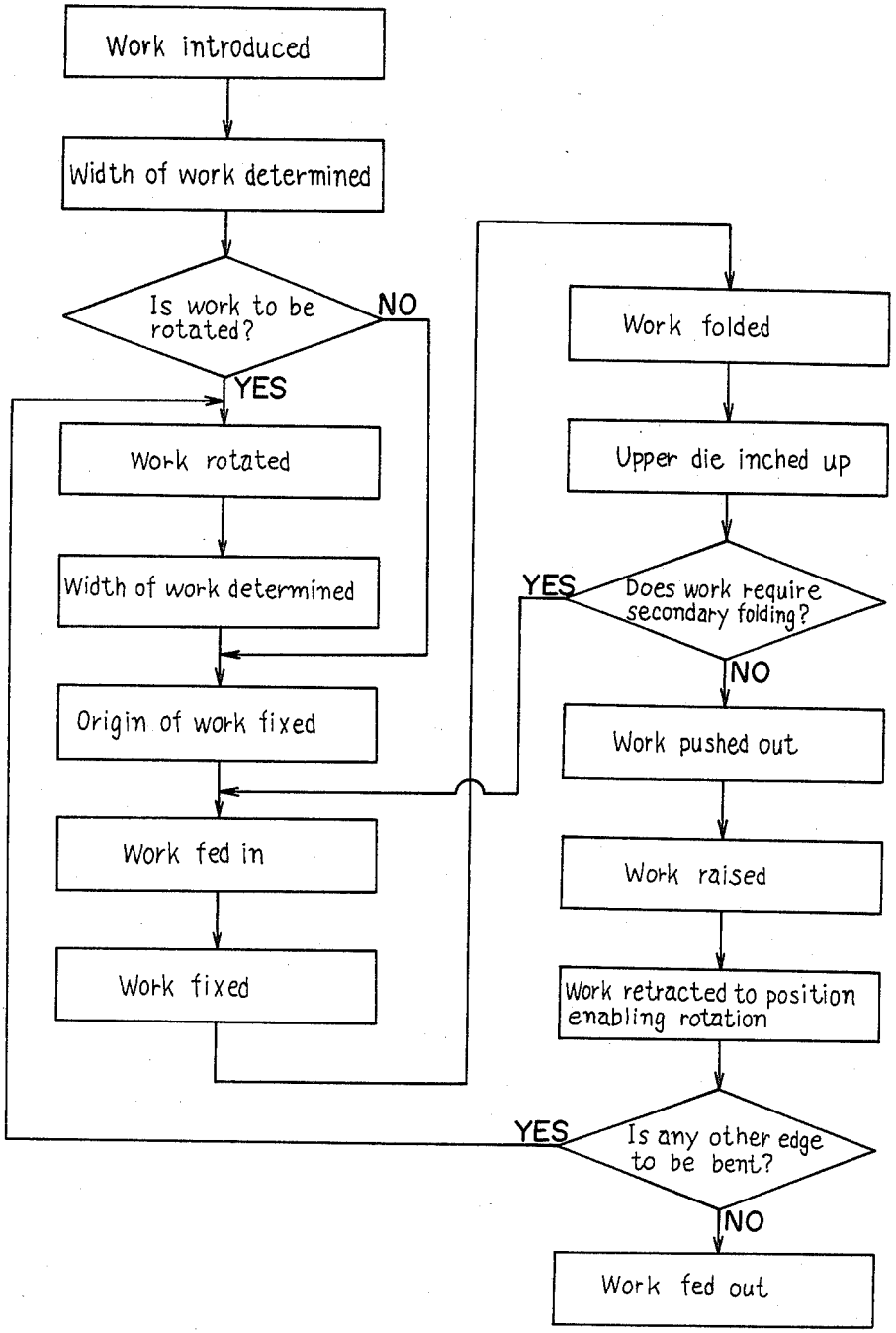
FIG. 9 is a flow chart of a work feeding apparatus.
Figure 10:
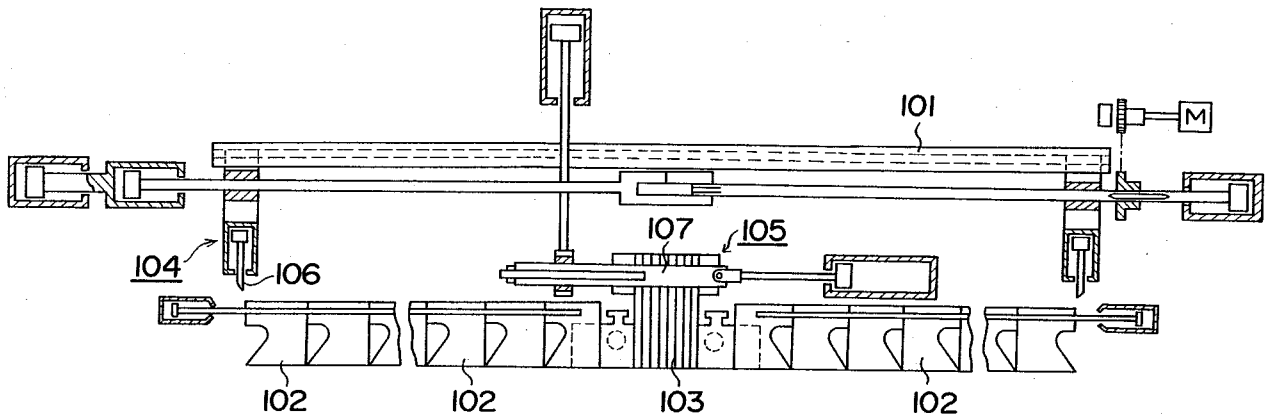
FIG. 10 (PRIOR ART)
FIG. 10 is a front view schematically illustrating a convertional split die.
Figure 11:
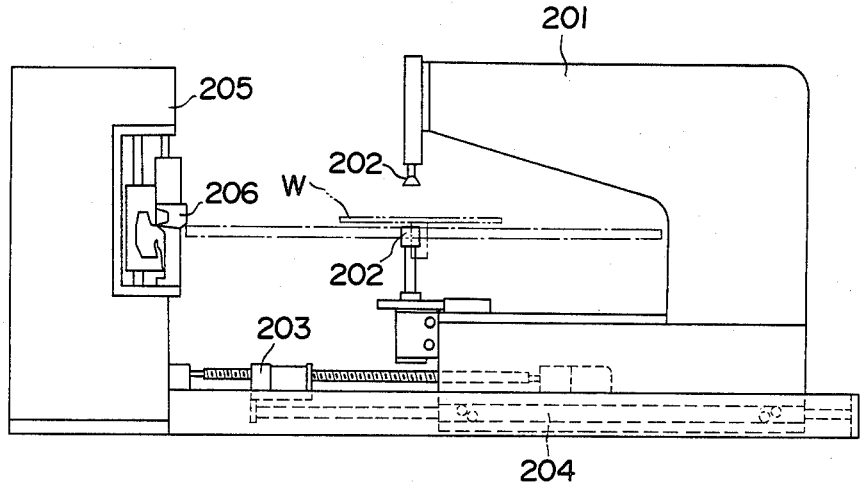
FIG. 11 (PRIOR ART)
FIG. 11 is a front view illustrating a typical conventional work feeding apparatus.

First, as shown in the flow chart of FIG. 9, when the work W is brought onto the front table 54, the limit switch 62 detects the passage of the work W across a fixed position and the work W is stopped substantially at the center of the table 54. At this time, the carriage 57 is disposed in advance so that the clamping means 75 will be positioned substantially at the center of the work W based on the input data concerning the delivered work W. Then, the claw members 63 of the width-determining mechanism 55 disposed outside the work W are moved inwardly to determine the width of the work W, namely, to center the work W in the direction perpendicular to the direction B of work feeding.

Then, the operation of fixing the origin is effected by rotating, or not rotating, the work W as occasion demands. Generally, the work W is conveyed in the longitudinal direction and, since the edges thereof in the longitudinal direction, namely, the shorter edges thereof, are folded first, the work is rotated by 90° in preparation for the folding operation. For the fixation of the origin, when the work W has been rotated as described above, it is to be subjected to the width-determining operation once again. Then, by means of the sub-carriage 58, the work W is forwarded toward the origin-fixing pin 73 and at least two origin-fixing pins 73 are pressed against the leading end of the work to set the work W at the position for starting the feeding motion. In this manner, the so-called origin-fixing operation is carried out. At this time, since the work W has already undergone the width-determining operation, it has been positioned with respect to the direction of feeding and the direction of width. By simply feeding the work W in situ in a stated amount, it can be accurately positioned within the work holder of the folding machine. The clamping means 75 of the carriage 57 is then closed to clamp the work W. Based on the data introduced in advance, the work W is fed in a stated amount into the work holder of the folding machine. When the work W has a width or length too small to be safely clamped at the center, as when the clamping of the work at the center thereof results in interference between the upper die 1 of the folding machine and the holder 80 of the clamp 75, the work W is nipped at the rear side thereof for the sake of the desired forward motion.

The work is folded while the leading end $W_1$ thereof is thrust out in a prescribed amount and nipped in that state by the work size and the operational procedure fed in the program in advance and with the procedure to be described below. At this time, the back-up heel 16 formed integrally on the rear side of the descending ram 4 and the back-up block 17 on the frame 5 side come into mutual engagement and substantially fix the upper die to the frame 5. In other words, the frame 5 and the upper die 1 are united in a direction in which the load for folding operation is exerted. On the other hand, the eccentric member 22 of the rocker arm 7 is rotated in a prescribed amount by the operation of the actuator 8 to give the clearance S a prescribed distance exceeding the thickness of the sheet. Then, to fold the leading end $W_1$ of the work W upwardly at 90°, the work W is held in situ and the upper and lower actuators 9, 10 are simultaneously set operating and the rocker-arm is consequently made to swing rapidly upwardly. By the ascending blade 6, the leading end $W_1$ of the work protruded from the work holder 3 is slowly folded. At this time, the clearance between the blade 6 and the work holder 3 is required to exceed the sheet thickness t and desired to be about 2.5t. Since the work W is folded without requiring the corner thereof to be harshly rubbed, it has no possibility of sustaining any scratches.

After the blade 6 has been raised to a prescribed position and the work W has been consequently folded gently, the work W is held in situ and the screw rod 24 of the stopper 23 is retracted in a prescribed amount in accordance with the program and the swinging end of the eccentric member 22 is shifted to a position corresponding to the folding angle which allows for possible spring back of the work.

By setting the actuator operating and consequently allowing the eccentric member 22 to swing until it collides with the screw rod 24, the rocker-arm 7 having the center $O_2$ of rotation thereof on the eccentric member 22 is translated or pushed in toward the work holder 3 and the leading end $W_1$ of the work w is further folded to a position which allows for possible spring back (as illustrated in FIG. 5). The amount of this translation of the rocker-arm 7 equals the horizontal-direction component of the motion of the rotated eccentric member 22. It can be fixed within the range of 2 times the maximum amount of eccentricity. In the present embodiment, the setting of the aforementioned clearance S and the setting of the amount of translation of the blade 6 required for further folding the leading end $W_1$ of the work already folded by the ascent of the blade 6 are both effected by one stopper 23. Optionally, separate stoppers or positioning means or control devices may be adapted for severally effecting the two kinds of setting mentioned above.

After completion of the folding operation, the rocker-arm 7 is retracted by the reversed operation of the actuator 8 and then suitably lowered to a waiting position by the reversed operation of the actuators 9, 10. The waiting position of the rocker-arm 7 and consequently that of the blade 6 can be suitably changed in accordance with the work folding conditions, for example, by utilizing the limit switches $L_1$, $L_2$, $L_3$, and $L_4$, for the purpose of avoiding generation of wasteful vertical motion. The limit switches $L_1$, $L_2$ are set in place near the opposite stroke ends of the actuator 10 to determine the rising end and the falling end of the upper and lower blades. Between these limit switches, as many limit switches as necessary for determining the waiting position of the blade 6 are set in place. Specifically, the limit switches $L_3$ and $L_4$ are set in place at the point where the lower blade assumes its position directly below the work holder 3 and the point where the upper blade assumes its position directly above the work holder 3, so that the blade 6 on the side about to be used will be retracted near the work holder and hence prevented from generating any wasteful motion. The blade 6, therefore, is kept waiting in accordance with the program or by a manual operation at the position of $L_3$ or that of $L_4$, depending on the direction of the next folding operation and, hence, is prevented from producing any wasteful stroke. After the blade has been retracted to the waiting position, the upper die 1 of the work holder 3 is inched upwardly until the work W is set free and the work W is suitably fed forwardly to avoid interference between the leading end $W_1$ of the folded work and the upper die 1 or to give the leading end $W_1$ of the work additional folding. When the leading end of the work which has already undergone the folding operation is to be subjected to the so-called secondary folding operation, such as for further folding of the folded leading edge in the reverse direction or for hemming the folded leading edge, the leading end is again thrust out in a prescribed amount and subjected to the aforementioned operation in accordance with the procedure described above. When no secondary folding operation is required, the work W is released from the clamping and then it is thrust out forwardly by the operation of the sub-carriage 58 and, hence, is prevented from interfering with the gooseneck bending die 1. Then, the upper die 1 is raised to remove the die.

Then, the work W as kept fastened by suction to the sub-carriage 58, is drawn out backwardly and, at the same time, the carriage 57 in its entirely is retracted and the work W is pulled out to a position where it can be rotated. Where the whole folding operation has been completed, the work is moved out of the front table 54 by the conveyor 61. Where the work has still any other side to be folded, the work W is again clamped, rotated by a prescribed angle, then subjected to the width-determining and origin-fixing operations, and fed in a prescribed into the folding machine. Though the work W which has changed its direction is fixed in place strongly, it cannot be positioned with perfect exactitude because of a slip possibly caused by inertia. Since the width-determining and origin-fixing operations are performed on the work W each time the work w is subjected to given folding operation, the work W can be disposed with the leading end thereof aligned with the center 0—0 of the machine. As the result, a deviation of position causable by the rotation of the work W and the accumulation of such deviations can be prevented and the feeding of the work W can be accomplished with high acuracy.

The operations of the drive motors 68, 96, and 98 and the cylindrical actuators 74 and 90 can be completely automated when they are modified so as to be regulated by the NC system or the CNC system.

The adjustment of the width of the work-holding split die in connection with the width of the work is effected by the following procedure.

When a sheet work W having the opposite ends thereof already folded and having a width of 700 mm and a thickness of 0.5 mm requires its leading end to be folded, for example, since the width, l, of the upper die 1 is represented by the following equation, $$l = L - 2t - 2\alpha$$

[ $L$: the outside width of the work
$t$: the thickness of sheet
$\alpha$: the clearance (equally apportioned to both sides), ]

the sum, $1+2\alpha$, is found as follows.

$$l + 2\alpha = 700 - (2 \times 0.5)$$
$$= 699 \text{ mm}$$

In this case, the block dies 27A, 27B are assumed each to have a maximum width of 200 mm. By subtracting the total maximum width of the opposite block dies 27A, 27B, 200 mm×2, from the value shown above, the maximum width of the segment dies 26 is found to be 299 mm. If each of the segment dies is assumed to have a size of 5 mm in the direction of width, then the number of segment dies 26 to be desired is found, thus: $299-5=59.8$. By discarding the fraction, 0.8, this number settles to 59. The clearance, $\alpha$, is calculated, thus: $\alpha=\frac{1}{2}[700[(2\times200)-(2\times0.5)-(59\times5)]=2$ mm. From the practical point of view, any clearance of the order of 2 mm presents no obstacle to the folding operation. Any fraction in the numerical value of the die width, 1 , is discarded by a unit pitch of 5 mm which is the thickness of each of the segment dies 26.

Extraction of segment dies 26 is effected by rotating the first and second screw rods 40, 44 in a prescribed amount thereby moving all the segment dies 26 to the left in the bearing shown in the diagrams and, at the same time, moving the movable key 31B in the same amount to the right in the bearing shown in the diagrams thereby removing equal numbers of segment dies 26 from the opposite ends of the entire group of segments dies and drawing a total width, 147.5 mm, of segment dies, specifically 59 segment dies, each from the opposite sides of the center 0—0 of the folding machine. The lefthand side group of segment dies 26 released from the selection keys 31A, 31B is immediately brought into engagement with the stoppers 32, 33 attached to the upper die proper 34 or the block die 27A and consequently prevented from continuing free rotation.

After prescribed numbers of segment dies have been selectively extracted from the group of segment dies 26, the drive cylinder at one end of the inverting shaft 29 is set operating to rotate the inverting shaft 29 by a prescribed angle, generally 180°, and invert the extracted group of segment dies 26. At this time, a clearance equalling in magnitude the width of the extracted group of segment dies 26 is produced because the block dies 27A, 27B on the opposite ends are moved in equal amounts away from or toward each other by the operation of the second screw rod 44 being rotated periodically by the timing belt 50. As the result, the extracted segment dies 26 are inverted and, at the same time, inserted between the block dies 27A, 27B to give birth to an upper die 1 of a prescribed width. The segment dies 26 which are inverted at this time are given a fixed position by coming into contact with the sliding gib 45 attached to the segment holder 30.

Subsequently, the dies are closed to pinch the sheet work W disposed at the prescribed position. In this case, the lateral folded edges $W_2$ of the work W can be inserted between the opposite block dies 27A, 27B without interfering with the block dies because the movable pieces 47 of the opposite block dies 27A, 27B in the descending upper die 1 are pushed down toward the lower die 2 by the operation of the spring 49 to cause a decrease in the width of the die. The block dies 27A, 27B which have avoided the lateral folded parts $W_2$ of the work W are automatically spread out to their inherent die width and allowed to pinch the work W because the movable pieces 47 are brought into contact with the work W and pushed upwardly away from each other. After the upper die 1 has extracted a desired number of segment dies 26 and inverted and inserted them between the block dies 27A, 27B, it has only to be lowered in situ so as to be closed to the prescribed width without interfering with the lateral folded edges $W_2$ of the work. Moreover, in the present apparatus, since the upper die always acquires a length equally apportioned on the opposite sides of the center 0—0 of the machine, there is no need of adjusting the relative positions of the upper die 1 and the work W.

After completion of the folding operation, the upper die 1 in its entirety is slightly raised by the elevation of the ram 4 and the work W is pushed out forwardly to ensure that the front inclined surfaces of the block dies 27A, 27B while being raised will avoid interfering with the front folded edges $W_1$ of the work. Thereafter, the work W is raised again to the limit of its ascent. It is then prepared for the next folding operation.

When the cylinders and the drive motor 51 mentioned above are adapted to be controlled by the NC system or CNC system, their operations can be automated.

As clearly noted from the description given above, the split die of the present invention for the folding operation is composed of a group of a multiplicity of thin-plate segment dies, a pair of block dies disposed one each at the opposite ends of the group of segment dies and adapted to be simultaneously moved in equal amounts away from or toward each other in the direction of width, and an shifting mechanism for extracting a desired number of segment dies by removing equal numbers of segment dies from the opposite ends of the group of segment dies and inverting the extracted segment dies and inserting them between the block dies, whereby the folding die of a desired width is obtained by simultaneously moving the block dies in equal amounts away from or toward each other to positions separated from the center of the die by multiples of the unit plate thickness of the segment dies and, at the same time, extracting a required number of segment dies from the group of segment dies and inserting the extracted segment dies between the block dies. Thus, the extracted segment dies are equally apportioned on the opposite sides of the center of the die without reference to the width of the die to give birth to a folding die of a desired width. The center of the folding machine and that of the die are, therefore, aligned automatically. When the work is fed in the machine as centered in advance with respect to the center of the machine, therefore, it can be readily subjected to the folding operation without any centering operation. When the various sorts of information on the sequentially arriving works, such as size and shape of works, folding conditions, and operational procedure, are memorized for the sake of the NC system or CNC system, therefore, the die which has been used in one folding operation can be immediately re-formed in a desired width and readied for the next folding operation. Thus, efficient manufacture of products on the basis of rich variety and limited quantity can be materialized.

Since the width-determining and origin-fixing operations are performed on the work for each of the edges to be folded before the work is fed in as required, any deflection of the fixed position due to the inertia produced during the rotation of the work is corrected before each action of feeding and the feeding can be made with high accuracy. The split die, when used with the folding machine, contributes to improving the accuracy of the folding operation. The work feeding apparatus is constructed so as to perform the width-determining and origin-fixing operations on the work for each of the edges of the work to be folded and set the work accurately at the position for starting the feeding, the work is not always required to be clamped at the center thereof but may be clamped, when necessary, at the end part thereof. When this apparatus is used with the folding machine, therefore, the smallest possible size of the work for which the work feeding apparatus of this invention can be utilized effectively is the sum (thickness of the gooseneck bending die in the feeding direction + diameter of the clamping plate + amount of thrust of the work) in the folded state. This means that the work can have a size smaller by the sum of the thickness of the gooseneck folding die and the amount of thrust of the work than the smallest possible size of the work for which the conventional apparatus can be effectively operated.

What is claimed is:

1. A split die used in a folding operation, comprising a grouped multiplicity of laterally divided thin-plate segment dies, a pair of block dies disposed one each at opposite ends of said group of segment dies and simultaneously movable in equal amounts away from or toward each other in a width direction of the dies, and a shifting mechanism for extracting a desired number of said segment dies by removing equal number of said segment dies from the opposite ends of said group of segment dies and inverting the extracted segment dies and inserting the extracted segment dies between said block dies so as to form a folding die of a desired width by equally apportioning said extracted segment dies on the opposite side of a center of the die of a folding machine.

2. A split die according to claim 1, wherein said shifting mechanism comprises an inverting shaft supporting said segment dies, a segment holder retaining said group of segment dies as a whole and connecting said group of segment dies to one of said block dies and moving said group of segment dies toward the other block die, and selection keys movable simultaneously in equal amount in a direction opposite the direction of motion of said segment hold to effect selective connection of said segment dies between said block dies to said inverting shaft.

3. A split die according to claim 1, wherein said block dies are each composed of a movable piece protruding in the direction of die width and a die, said movable piece being attached swingably and suspendibly to said dies, movement of said movable pieces being utilized to vary die width.

4. A split die according to claim 1, wherein said block dies are supported by a screw rod having a rightand screw and a lefthand screw both cut at a fixed pitch so that the rotation of said screw rod causes said block dies to move simultaneously in equal amounts away from or toward each other.

5. A split die according to claim 1, wherein said segment dies are provided with segment holders and stoppers disposed outside said block dies are simultaneously movable in opposite directions so that the segment dies positioned outside the block dies will be connected and prevented from rotation.

6. A split die according to claim 1, wherein operation of said movable selection key and of one of said block dies and the operation of said segment holder and that of the other block die are synchronized.

7. A split die according to claim 2, wherein said selection keys of said shifting mechanism consist of a stationary key positioned on one side of the center of the die of a folding machine and a movable key positioned on the other side of said center to be freely shifted toward said stationary key, said segment dies are extracted as equally apportioned on both sides of said center of the folding machine by causing said segment holder retaining said group of segment dies to be shifted in an equal amount in the same direction as the block die on the stationary selecting key side and, at the same time, causing said movable selection key to be shifted in equal amount in a position opposite the direction of said segment holder.

8. A split die according to claim 2, wherein said inverting shaft is a three-wall tube comprising an outer tube rotatably supporting said group of segment dies, an intermediate tube and an inner tube connected to a freely selected segment die through the medium of one of said stationary selection key and said movable selection key.

9. A split die according to claim 2, wherein one of said block dies and said segment holder are connected to each other by having an inner surface of said segment holder in sliding contact with said segment dies and an inner surface of said block die held in intimate contact with each other and said segment holder is shifted outside an interval between the block dies to permit reduction of space separating the block dies.

10. A split die according to claim 4, wherein said screw rod of said block dies synchronously rotated with a screw rod for moving said movable selection key.

* * * * *